US010508554B2

(12) United States Patent
Chouhan et al.

(10) Patent No.: US 10,508,554 B2
(45) Date of Patent: Dec. 17, 2019

(54) TURBINE BUCKET HAVING OUTLET PATH IN SHROUD

(71) Applicant: General Electric Company, Schenectady, NY (US)

(72) Inventors: Rohit Chouhan, Karnataka (IN); Shashwat Swami Jaiswal, Karnataka (IN); Gunnar Leif Siden, Greenville, SC (US); Zachary James Taylor, Greenville, SC (US)

(73) Assignee: General Electric Company, Schenectady, NY (US)

( * ) Notice: Subject to any disclaimer, the term of this patent is extended or adjusted under 35 U.S.C. 154(b) by 606 days.

(21) Appl. No.: 14/923,693

(22) Filed: Oct. 27, 2015

(65) Prior Publication Data

US 2017/0114647 A1 Apr. 27, 2017

(51) Int. Cl.
*F01D 5/18* (2006.01)
*F01D 5/02* (2006.01)
(Continued)

(52) U.S. Cl.
CPC ..... *F01D 5/187* (2013.01); *F01D 1/32* (2013.01); *F01D 5/02* (2013.01); *F01D 5/225* (2013.01);
(Continued)

(58) Field of Classification Search
CPC . F01D 5/18; F01D 5/187; F01D 5/255; F05D 2220/3215; F05D 2240/307
See application file for complete search history.

(56) References Cited

U.S. PATENT DOCUMENTS 3,045,965 A 7/1962 Bowmer
3,623,825 A 11/1971 Schneider
(Continued)

FOREIGN PATENT DOCUMENTS

EP 0670953 B1 5/1998
EP 0864728 A2 9/1998
(Continued)

OTHER PUBLICATIONS

Extended European Search Report and Opinion issued in connection with corresponding EP Application No. 16194236.2 dated Mar. 21, 2017.
(Continued)

*Primary Examiner* — Carlos A Rivera
*Assistant Examiner* — Cameron A Corday
(74) *Attorney, Agent, or Firm* — Dale Davis; Hoffman Warnick LLC

(57) ABSTRACT

A turbine bucket according to embodiments includes: a base; a blade coupled to base and extending radially outward from base, blade including: a body having: a pressure side; a suction side opposing pressure side; a leading edge between pressure side and suction side; and a trailing edge between pressure side and suction side on a side opposing leading edge; and a plurality of radially extending cooling passageways within body; and a shroud coupled to blade radially outboard of blade, shroud including: a plurality of radially extending outlet passageways fluidly connected with a first set of the plurality of radially extending cooling passageways within body; and an outlet path extending at least partially circumferentially through shroud and fluidly connected with all of a second, distinct set of the plurality of radially extending cooling passageways within body.

6 Claims, 10 Drawing Sheets

(51) Int. Cl.
*F01D 5/22* (2006.01)
*F01D 9/02* (2006.01)
*F01D 1/32* (2006.01)

(52) U.S. Cl.
CPC ..... *F01D 9/02* (2013.01); *F05D 2220/32* (2013.01); *F05D 2260/20* (2013.01)

(56) References Cited

U.S. PATENT DOCUMENTS 3,658,439 A 4/1972 Kydd
3,736,071 A 5/1973 Kydd
3,804,551 A 4/1974 Moore
3,844,679 A 10/1974 Grondahl et al.
4,236,870 A 12/1980 Hucul, Jr. et al.
4,350,473 A 9/1982 Dakin
4,474,532 A 10/1984 Pazder
5,403,159 A 4/1995 Green et al.
5,460,486 A 10/1995 Evans et al.
5,464,479 A 11/1995 Kenton et al.
5,482,435 A 1/1996 Dorris et al.
5,488,825 A 2/1996 Davis et al.
5,603,606 A 2/1997 Glezer et al.
5,829,245 A 11/1998 McQuiggan et al.
5,857,837 A 1/1999 Zelesky et al.
5,902,093 A 5/1999 Liotta et al.
6,164,914 A 12/2000 Correia et al.
6,431,832 B1 8/2002 Glezer et al.
6,499,950 B2 12/2002 Willett et al.
6,761,534 B1 * 7/2004 Willett ..... F01D 5/18 416/191
6,824,359 B2 11/2004 Chlus et al.
6,902,372 B2 6/2005 Liang
6,974,308 B2 12/2005 Halfmann et al.
7,066,716 B2 * 6/2006 Jacala ..... F01D 5/186 415/115
7,104,757 B2 9/2006 Gross
7,137,779 B2 11/2006 Liang
7,198,468 B2 4/2007 Papple
7,303,376 B2 12/2007 Liang
7,481,623 B1 1/2009 Liang
7,537,431 B1 5/2009 Liang
7,563,072 B1 7/2009 Liang
7,645,122 B1 1/2010 Liang
7,686,581 B2 3/2010 Brittingham et al.
7,753,650 B1 7/2010 Liang
7,766,617 B1 8/2010 Liang
7,780,414 B1 8/2010 Liang
7,857,589 B1 12/2010 Liang
7,862,299 B1 1/2011 Liang
7,901,181 B1 3/2011 Liang
7,901,183 B1 3/2011 Liang
8,011,888 B1 9/2011 Liang
8,047,788 B1 11/2011 Liang
8,052,378 B2 11/2011 Draper
8,052,395 B2 11/2011 Tragesser et al.
8,070,436 B2 12/2011 Mitchell
8,100,654 B1 1/2012 Liang
8,113,780 B2 2/2012 Cherolis et al.
8,118,553 B2 2/2012 Liang
8,177,507 B2 5/2012 Pietraszkiewicz et al.
8,192,146 B2 6/2012 Liang
8,297,927 B1 10/2012 Liang
8,348,612 B2 1/2013 Brittingham
8,360,726 B1 1/2013 Liang
8,444,372 B2 5/2013 Suthar et al.
8,500,401 B1 8/2013 Liang
8,628,298 B1 1/2014 Liang
8,702,375 B1 4/2014 Liang
8,801,377 B1 8/2014 Liang
8,920,123 B2 12/2014 Lee
9,206,695 B2 12/2015 Pointon et al.
9,228,439 B2 1/2016 Pointon et al.
9,314,838 B2 4/2016 Pointon et al.
9,518,469 B2 12/2016 Tibbott et al.
9,885,243 B2 * 2/2018 Chouhan ..... F01D 5/18
2001/0012484 A1 8/2001 Beeck et al.
2002/0197159 A1 12/2002 Roeloffs
2002/0197160 A1 12/2002 Liang
2003/0059304 A1 3/2003 Leeke et al.
2003/0118445 A1 6/2003 Lee et al.
2003/0133795 A1 7/2003 Manning et al.
2003/0147750 A1 8/2003 Slinger et al.
2004/0126236 A1 7/2004 Lee et al.
2004/0146401 A1 7/2004 Chlus et al.
2004/0151582 A1 8/2004 Faulkner
2005/0111979 A1 5/2005 Liang
2005/0265837 A1 12/2005 Liang
2006/0056969 A1 3/2006 Jacala et al.
2006/0222494 A1 10/2006 Liang
2007/0177976 A1 8/2007 Cunha et al.
2007/0189896 A1 8/2007 Itzel et al.
2008/0008599 A1 1/2008 Cunha et al.
2008/0031738 A1 2/2008 Lee
2008/0056908 A1 3/2008 Morris et al.
2008/0170946 A1 7/2008 Brittingham et al.
2008/0286115 A1 11/2008 Liang
2009/0196737 A1 8/2009 Mitchell
2009/0214328 A1 8/2009 Tibbott et al.
2009/0304520 A1 12/2009 Brittingham et al.
2010/0040480 A1 2/2010 Webster et al.
2011/0123351 A1 5/2011 Hada et al.
2012/0082567 A1 4/2012 Tibbott et al.
2012/0107134 A1 5/2012 Harris, Jr. et al.
2012/0171047 A1 7/2012 Itzel et al.
2013/0115059 A1 5/2013 Walunj et al.
2013/0323080 A1 12/2013 Martin et al.
2014/0093389 A1 4/2014 Morris et al.
2014/0093390 A1 4/2014 Pointon et al.
2014/0093392 A1 4/2014 Tibbott et al.
2016/0017718 A1 1/2016 Zhang et al.
2017/0114648 A1 * 4/2017 Chouhan ..... F01D 5/02

FOREIGN PATENT DOCUMENTS

EP 1116861 A2 7/2001
EP 1 219 781 A2 7/2002
GB 2005775 A 9/1978
JP S59231102 A 12/1984
JP H01134003 A 5/1989
JP H05156901 A 6/1993
JP H05248204 A 9/1993
JP H1172005 A 3/1999
JP H11223101 A 8/1999
JP 2001073704 A 3/2001
JP 2001193404 A 7/2001
JP 2005054799 A 3/2005
JP 2005069236 A 3/2005
JP 2005337256 A 12/2005
JP 2006037957 A 2/2006
JP 2008169845 A 7/2008
JP 2012140946 A 7/2012
JP 2013117227 A 6/2013
JP 2013144994 A 7/2013
JP 2013245674 A 12/2013
JP 2016156377 A 9/2016

OTHER PUBLICATIONS

U.S. Appl. No. 14/923,697, Office Action 1 dated Oct. 6, 2017, 32 pages.
U.S. Appl. No. 14/923,685, Office Action 1 dated Aug. 15, 2017, 24 pages.
U.S. Appl. No. 14/923,685, Notice of Allowance dated Nov. 17, 2017, 18 pages.
U.S. Appl. No. 14/923,697 Final Office Action dated Apr. 5, 2018, 25 pages.
U.S. Appl. No. 14/923,697, Notice of Allowance, dated Aug. 9, 2018, 23 pages.

* cited by examiner

TURBINE BUCKET HAVING OUTLET PATH IN SHROUD

BACKGROUND OF THE INVENTION

The subject matter disclosed herein relates to turbines. Specifically, the subject matter disclosed herein relates to buckets in gas turbines.

Gas turbines include static blade assemblies that direct flow of a working fluid (e.g., gas) into turbine buckets connected to a rotating rotor. These buckets are designed to withstand the high-temperature, high-pressure environment within the turbine. Some conventional shrouded turbine buckets (e.g., gas turbine buckets), have radial cooling holes which allow for passage of cooling fluid (i.e., high-pressure air flow from the compressor stage) to cool those buckets. However, this cooling fluid is conventionally ejected from the body of the bucket at the radial tip, and can end up contributing to mixing losses in that radial space.

BRIEF DESCRIPTION OF THE INVENTION

Various embodiments of the disclosure include a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

A first aspect of the disclosure includes: a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

A second aspect of the disclosure includes: a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a notch delineating an approximate mid-point between a leading half and a trailing half of the shroud; and an outlet path extending at least partially circumferentially through the shroud from the leading half to the trailing half, and fluidly connected with the plurality of radially extending cooling passageways within the body.

A third aspect of the disclosure includes: a turbine having: a stator; and a rotor contained within the stator, the rotor having: a spindle; and a plurality of buckets extending radially from the spindle, at least one of the plurality of buckets including: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
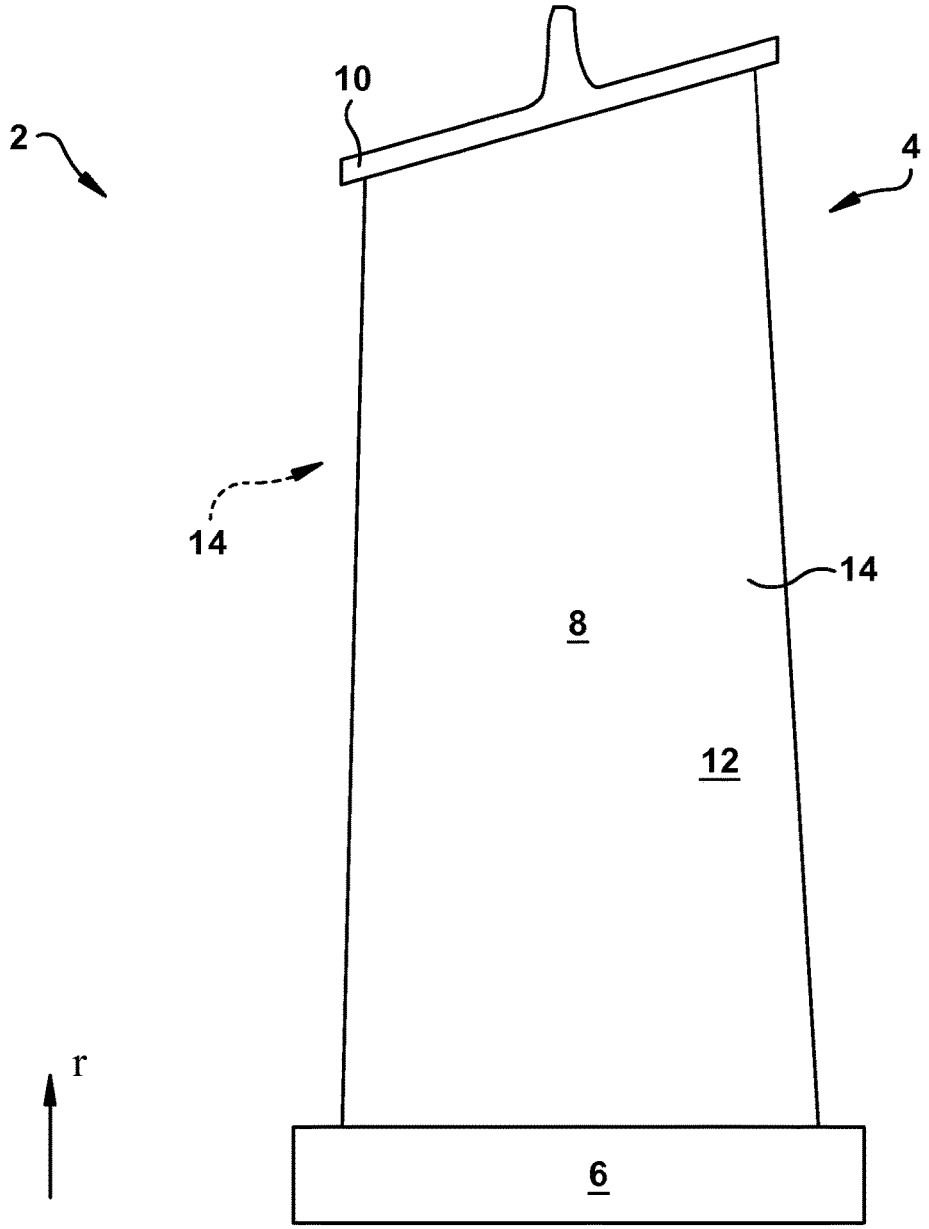
FIG. 1 shows a side schematic view of a turbine bucket according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted herein, the subject matter disclosed relates to turbines. Specifically, the subject matter disclosed herein relates to cooling fluid flow in gas turbines.

In contrast to conventional approaches, various embodiments of the disclosure include gas turbomachine (or, turbine) buckets having a shroud including an outlet path. The outlet path can be fluidly connected with a plurality of radially extending cooling passageways in the blade, and can direct outlet of cooling fluid from a set (e.g., two or more) of those cooling passageways to a location radially adjacent the shroud, and proximate the trailing edge of the bucket.

As denoted in these Figures, the "A" axis represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. It is further understood that common numbering between FIGURES can denote substantially identical components in the FIGURES.

In order to cool buckets in a gas turbine, cooling flow should have a significant velocity as it travels through the cooling passageways within the airfoil. This velocity can be achieved by supplying the higher pressure air at bucket base/root relative to pressure of fluid/hot gas in the radially outer region of the bucket. Cooling flow exiting at the radially outer region at a high velocity is associated with high kinetic energy. In conventional bucket designs with cooling outlets ejecting this high kinetic energy cooling flow in radially outer region, most of this energy not only goes waste, but also creates additional mixing losses in the radially outer region (while it mixes with tip leakage flow coming from gap between the tip rail and adjacent casing).

Figure 2:
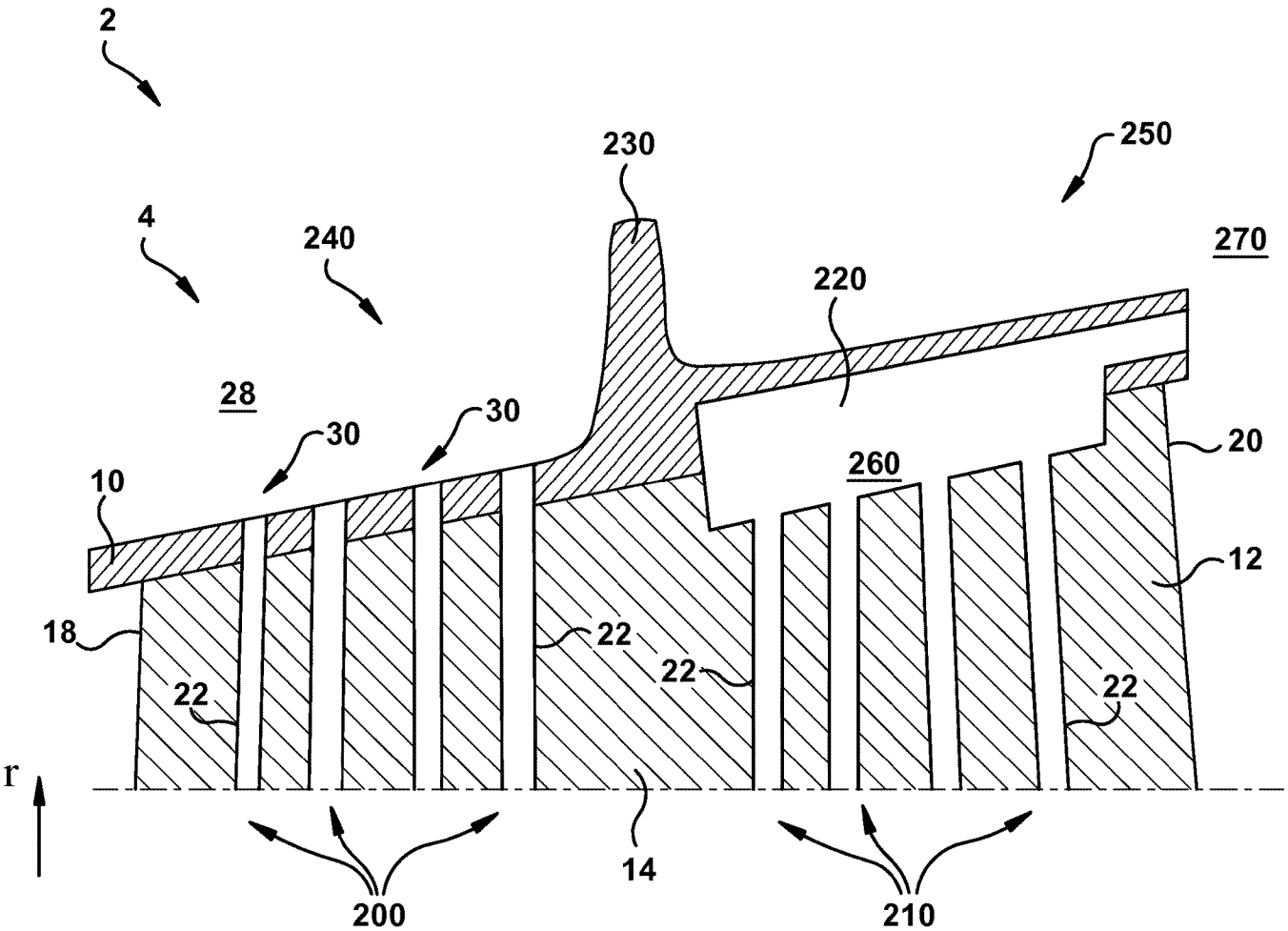
FIG. 2 shows a close-up cross-sectional view of the bucket of FIG. 1 according to various embodiments.

Turning to FIG. 1, a side schematic view of a turbine bucket 2 (e.g., a gas turbine blade) is shown according to various embodiments. FIG. 2 shows a close-up cross-sectional view of bucket 2, with particular focus on the radial tip section 4 shown generally in FIG. 1. Reference is made to FIGS. 1 and 2 simultaneously. As shown, bucket 2 can include a base 6, a blade 8 coupled to base 6 (and extending radially outward from base 6, and a shroud 10 coupled to the blade 8 radially outboard of blade 8. As is known in the art, base 6, blade 8 and shroud 10 may each be formed of one or more metals (e.g., steel, alloys of steel, etc.) and can be formed (e.g., cast, forged or otherwise machined) according to conventional approaches. Base 6, blade 8 and shroud 10 may be integrally formed (e.g., cast, forged, three-dimensionally printed, etc.), or may be formed as separate components which are subsequently joined (e.g., via welding, brazing, bonding or other coupling mechanism).

In particular, FIG. 2 shows blade 8 which includes a body 12, e.g., an outer casing or shell. The body 12 (FIGS. 1-2) has a pressure side 14 and a suction side 16 opposing pressure side 14 (suction side 16 obstructed in FIG. 2). Body 12 also includes a leading edge 18 between pressure side 14 and suction side 16, as well as a trailing edge 20 between pressure side 14 and suction side 16 on a side opposing leading edge 18. As seen in FIG. 2, bucket 2 also includes a plurality of radially extending cooling passageways 22 within body 12. These radially extending cooling passageways 22 can allow cooling fluid (e.g., air) to flow from a radially inner location (e.g., proximate base 6) to a radially outer location (e.g., proximate shroud 10). The radially extending cooling passageways 22 can be fabricated along with body 12, e.g., as channels or conduits during casting, forging, three-dimensional (3D) printing, or other conventional manufacturing technique.

As shown in FIG. 2, in some cases, shroud 10 includes a plurality of outlet passageways 30 extending from the body 12 to radially outer region 28 (e.g., proximate leading edge 18 of body 12. Outlet passageways 30 are each fluidly coupled with a first set 200 of the radially extending cooling passageway 22, such that cooling fluid flowing through corresponding radially extending cooling passageway(s) 22 (in first set 200) exits body 12 through outlet passageways 30 extending through shroud 10. In various embodiments, as shown in FIG. 2, outlet passageways 30 are fluidly isolated from a second set 210 (distinct from first set 200) of radially extending cooling passageways 22. That is, as shown in FIG. 2, in various embodiments, the shroud 10 includes an outlet path 220 extending at least partially circumferentially through shroud 10 and fluidly connected with all of second set 210 of the radially extending cooling passageways 22 in the body 12. Shroud 10 includes outlet path 220 which provides an outlet for a plurality (e.g., 2 or more, forming second set 210) of radially extending cooling passageways 22, and provides a fluid pathway isolated from radially extending cooling passageways 22 in first set 200.

As seen in FIGS. 1 and 2, shroud 10 can include a notch (rail) 230 delineating an approximate mid-point between a leading half 240 and a trailing half 250 of shroud 10. In various embodiments, an entirety of cooling fluid passing through second set 210 of radially extending cooling passageways 22 exits body 12 through outlet path 220. In various embodiment, first set 200 of radially extending cooling passageways 22 outlet to the location 28 radially outboard of shroud 10, while second set 210 of radially extending cooling passageways 22 outlet to a location 270 radially adjacent shroud 10 (e.g., radially outboard of body 12, radially inboard of outermost point of shroud notch 230). In some cases, the outlet path 220 is fluidly connected with a chamber 260 within body 12 of blade 8, where chamber 260 provides a fluid passageway between second set 210 of radially extending cooling passageways 22 and outlet path 220 in shroud 10. It is further understood that in various embodiments, chamber 260/outlet path 220 can include ribs or guide vanes (FIG. 9) to help align the flow of cooling fluid with a desired trajectory of fluid as it exits shroud 10.

Figure 3:
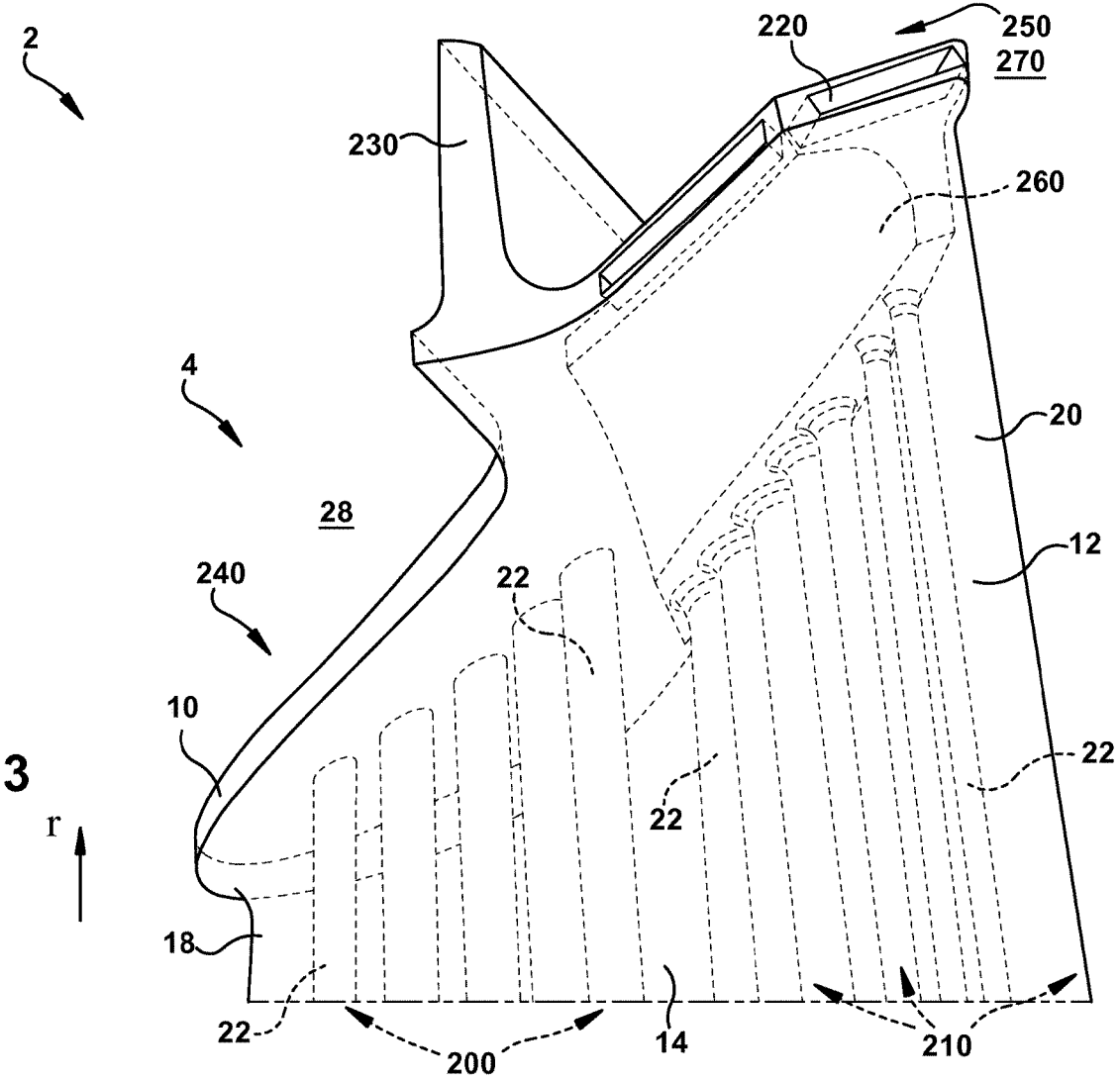
FIG. 3 shows a partially transparent three-dimensional perspective view of the bucket of FIG. 2.

FIG. 3 shows a partially transparent three-dimensional perspective view of bucket 2, viewed from under shroud 10, depicting various features. It is understood, and more clearly illustrated in FIG. 3, that outlet path 220, which is part of shroud 10, is fluidly connected with chamber 260, such that chamber 260 may be considered an extension of outlet path 220, or vice versa. Further, chamber 260 and outlet path 220 may be formed as a single component (e.g., via conventional manufacturing techniques). It is further understood that the portion of shroud 10 at trailing half 250 may have a greater thickness (measured radially) than the portion of shroud 10 at trailing half 250, for example, in order to accommodate for outlet path 220.

Figure 4:
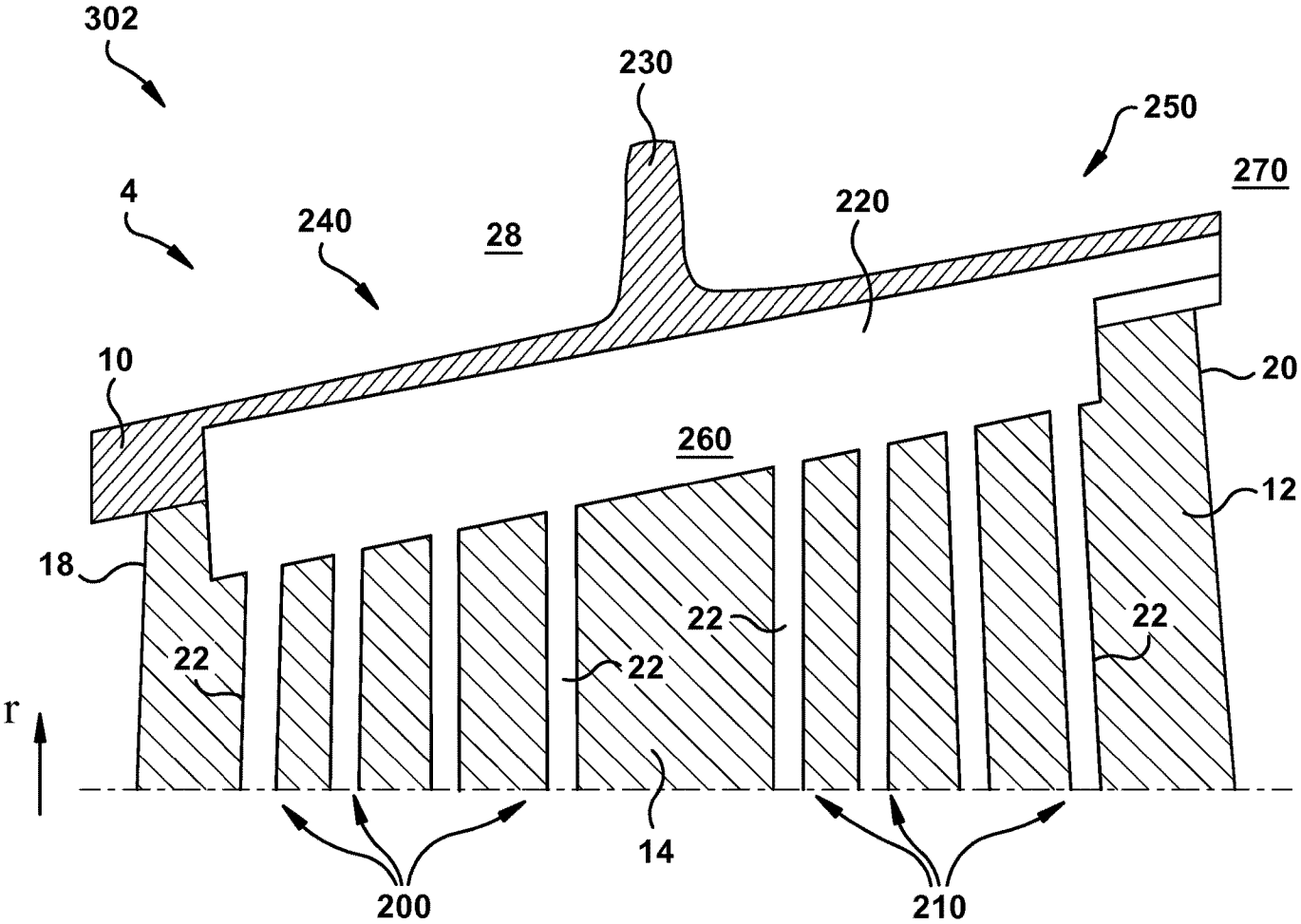
FIG. 4 shows a close-up cross-sectional view of a bucket according to various additional embodiments.

In FIG. 4, according to various additional embodiments described herein, a bucket 302 is shown including outlet path 220 extending between leading half 240 and trailing half 250 within the shroud 10, such that an entirety of the cooling flow from both first set 200 of radially extending cooling passageways and second set 210 of radially extending cooling passageways flows through outlet path 220. As with the embodiment of bucket 2 shown in FIG. 2, bucket 302 can also include a chamber 260 sized to coincide with outlet path 220. In this embodiment, the outlet path 220 extends through notch 230 between leading half 240 and trailing half 250 of shroud 10, and outlet proximate trailing edge 20 of body 12, at location 270, radially adjacent shroud 10. In various particular embodiments, outlet path 220 spans from approximately the leading edge 18 of the body 12 to approximately trailing edge 20 of body 12.

Figure 5:
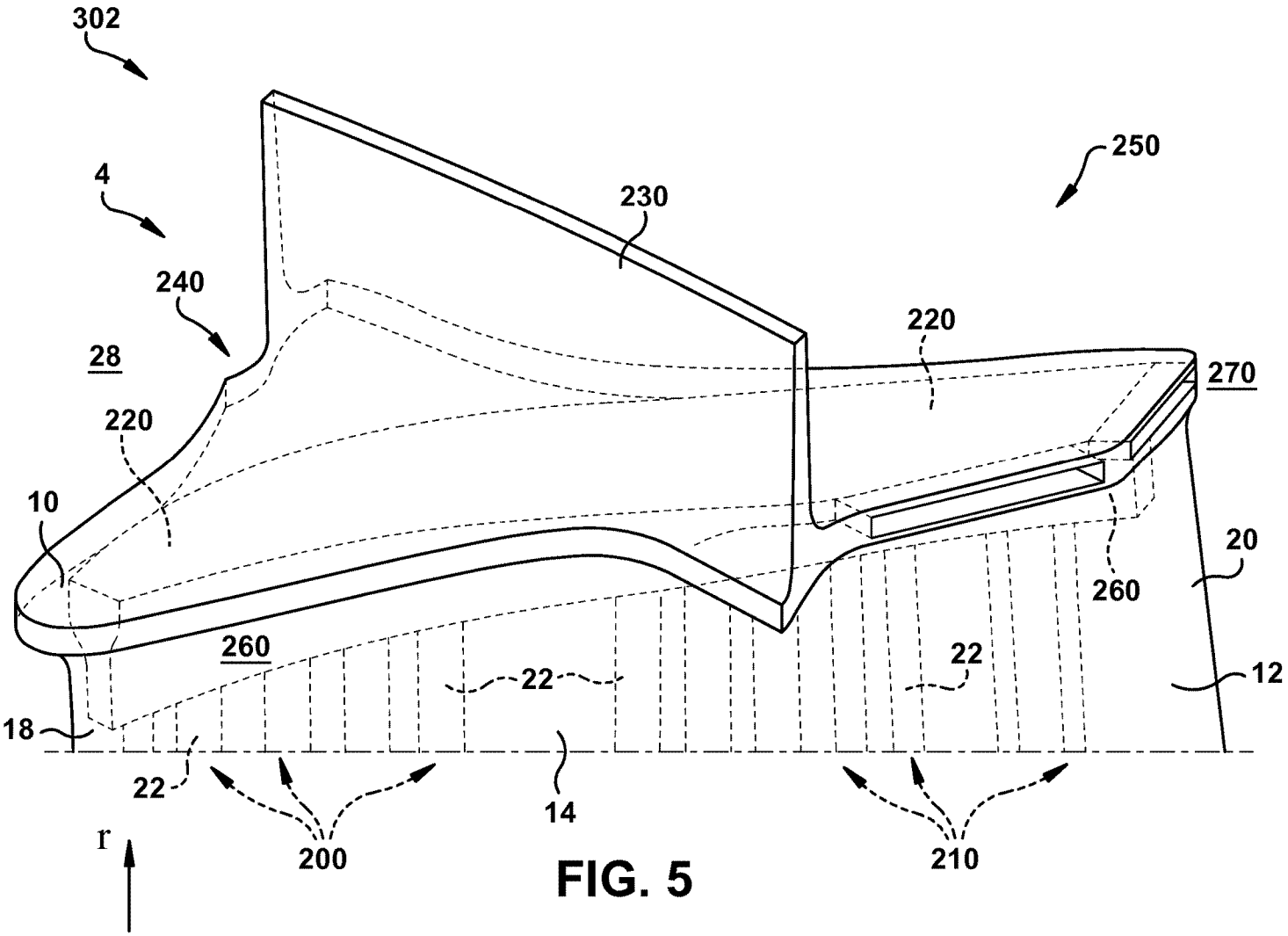
FIG. 5 shows a partially transparent three-dimensional perspective view of the bucket of FIG. 4

FIG. 5 shows a partially transparent three-dimensional perspective view of bucket 302, depicting various features. It is understood, and more clearly illustrated in FIG. 5, that outlet path 220, which is part of shroud 10, is fluidly connected with chamber 260, such that chamber 260 may be considered an extension of outlet path 220, or vice versa. Further, chamber 260 and outlet path 220 may be formed as a single component (e.g., via conventional manufacturing techniques). It is further understood that the portion of shroud 10 at trailing half 250 may a substantially similar thickness (measured radially) as the portion of shroud 10 at leading half 240.

Figure 6:
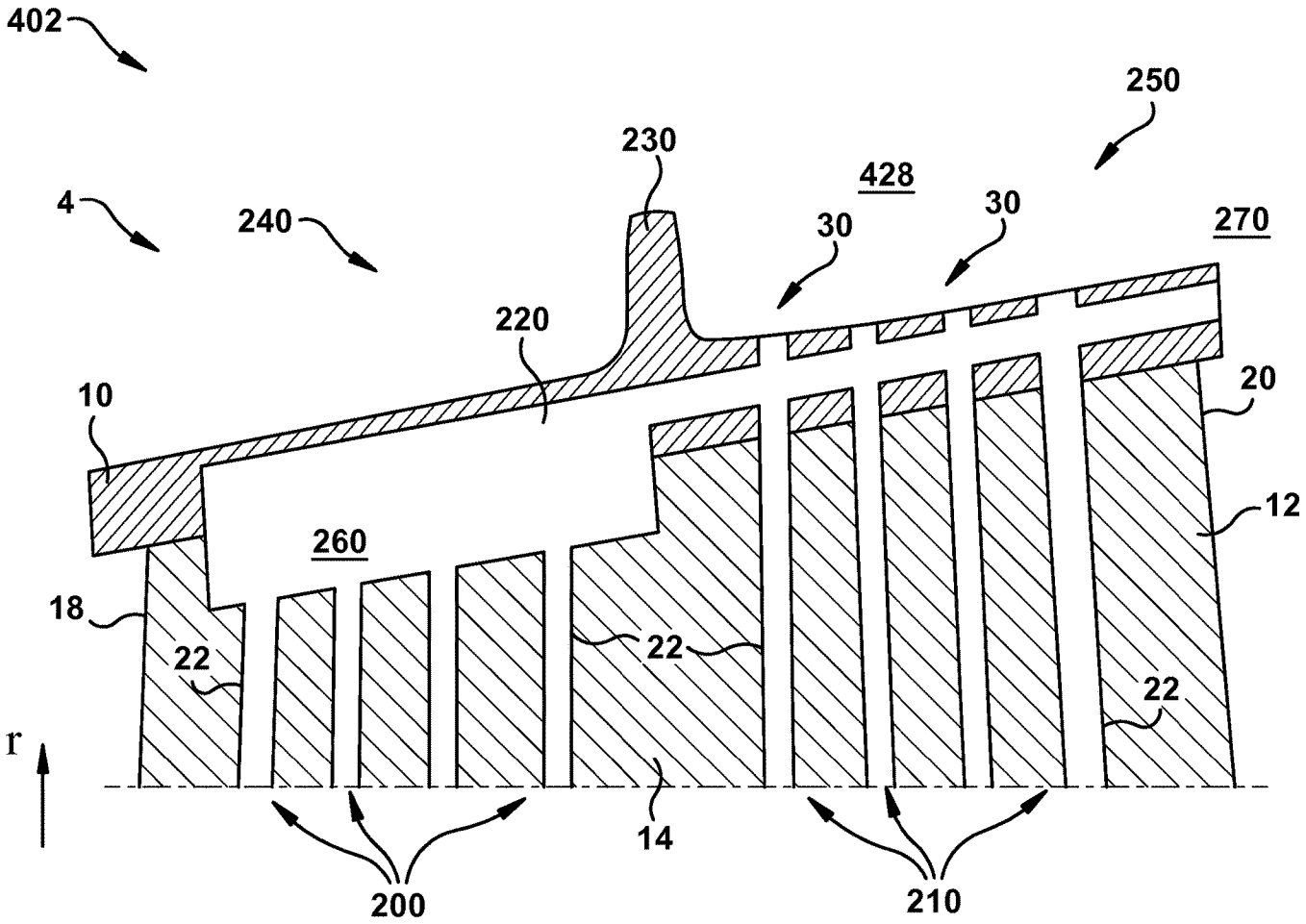
FIG. 6 shows a close-up cross-sectional view of a bucket according to various additional embodiments.
Figure 7:
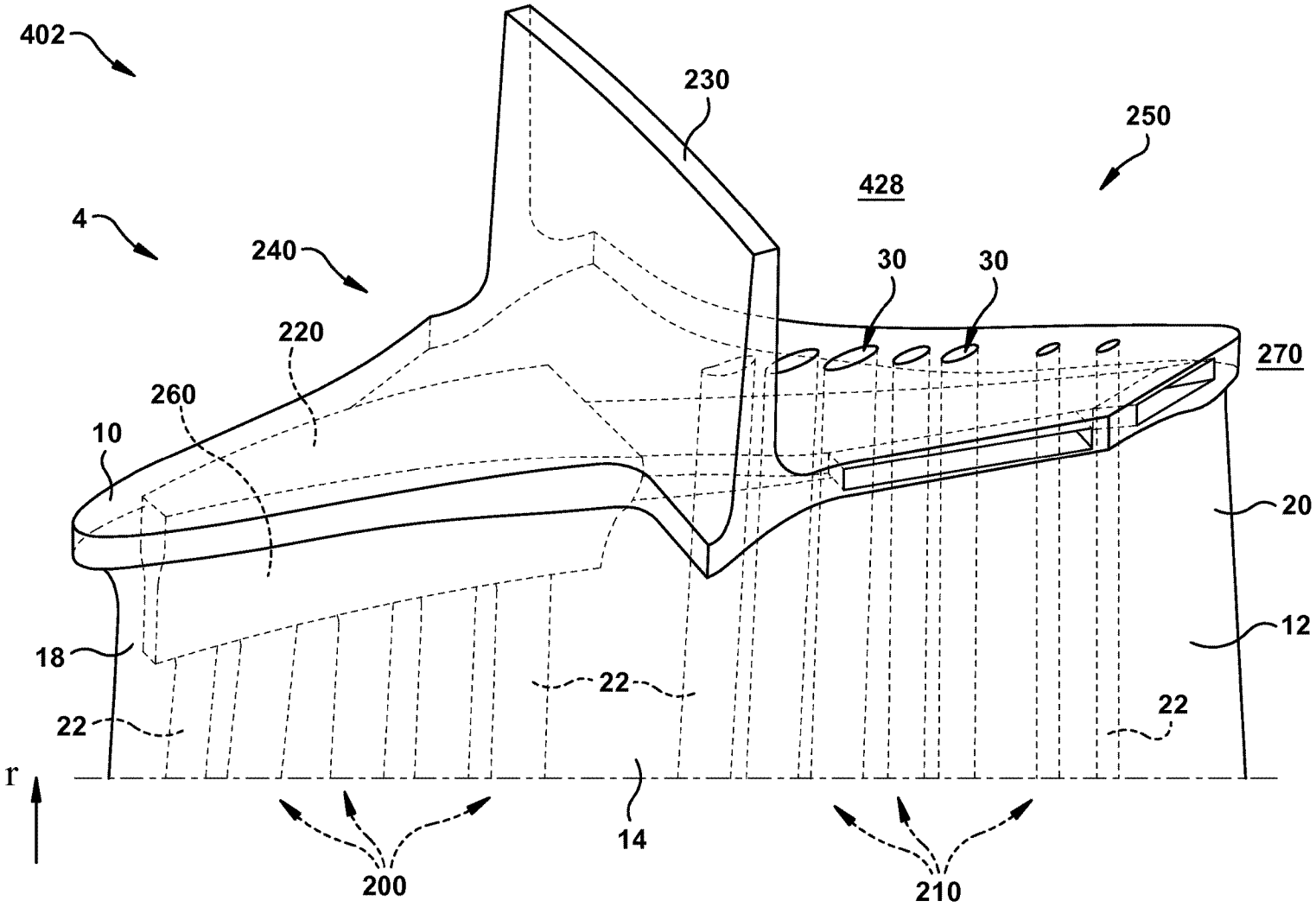
FIG. 7 shows a partially transparent three-dimensional perspective view of the bucket of FIG. 6.

FIG. 6 shows a bucket 402 according to various additional embodiments. As shown, bucket 402 can include outlet passageways 30 are each fluidly coupled with the second set 210 of the radially extending cooling passageway 22, such that cooling fluid flowing through corresponding radially extending cooling passageway(s) 22 (in second set 210) exits body 12 through outlet passageways 30 extending through shroud 10. In various embodiments, outlet passageways 30 are fluidly isolated from the first set 200 of radially extending cooling passageways 22 in the body 12. As described with respect to other embodiments herein, shroud 10 in bucket 402 may also include outlet path 220 extending at least partially circumferentially through shroud and fluidly connected with all of first set 200 of the radially extending cooling passageways 22 in the body 12. Outlet path 220 provides an outlet for a plurality (e.g., 2 or more, forming first set 200) of radially extending cooling passageways 22. Bucket 402 can also include chamber 260 fluidly coupled with outlet path 220, and located proximate leading half 240 of shroud 10. In this embodiment, the outlet path 220 extends through notch 230 between leading half 240 and trailing half 250 of shroud 10, and outlets proximate trailing edge 20 of body 12, at location 270, radially adjacent shroud 10. In various particular embodiments, outlet path 220 spans from approximately the leading edge 18 of the body 12 to approximately trailing edge 20 of body 12. In particular embodiments, as can be seen more effectively in the schematic partially transparent three-dimensional depiction of bucket 402 in FIG. 7, a set of radially extending outlet passageways 30 (in second set 210, proximate trailing edge 20) bypass outlet path 220, and permit flow of cooling fluid to radially outer region 428, located radially outboard of outlet passageways 30 and shroud 10. It is understood, and more clearly illustrated in FIG. 7, that outlet path 220, which is part of shroud 10, is fluidly connected with chamber 260, such that chamber 260 may be considered an extension of outlet path 220, or vice versa. Further, chamber 260 and outlet path 220 may be formed as a single component (e.g., via conventional manufacturing techniques). It is further understood that the portion of shroud 10 at leading half 240 may a substantially greater thickness (measured radially) than the portion of shroud 10 at trailing half 250.

Figure 8:
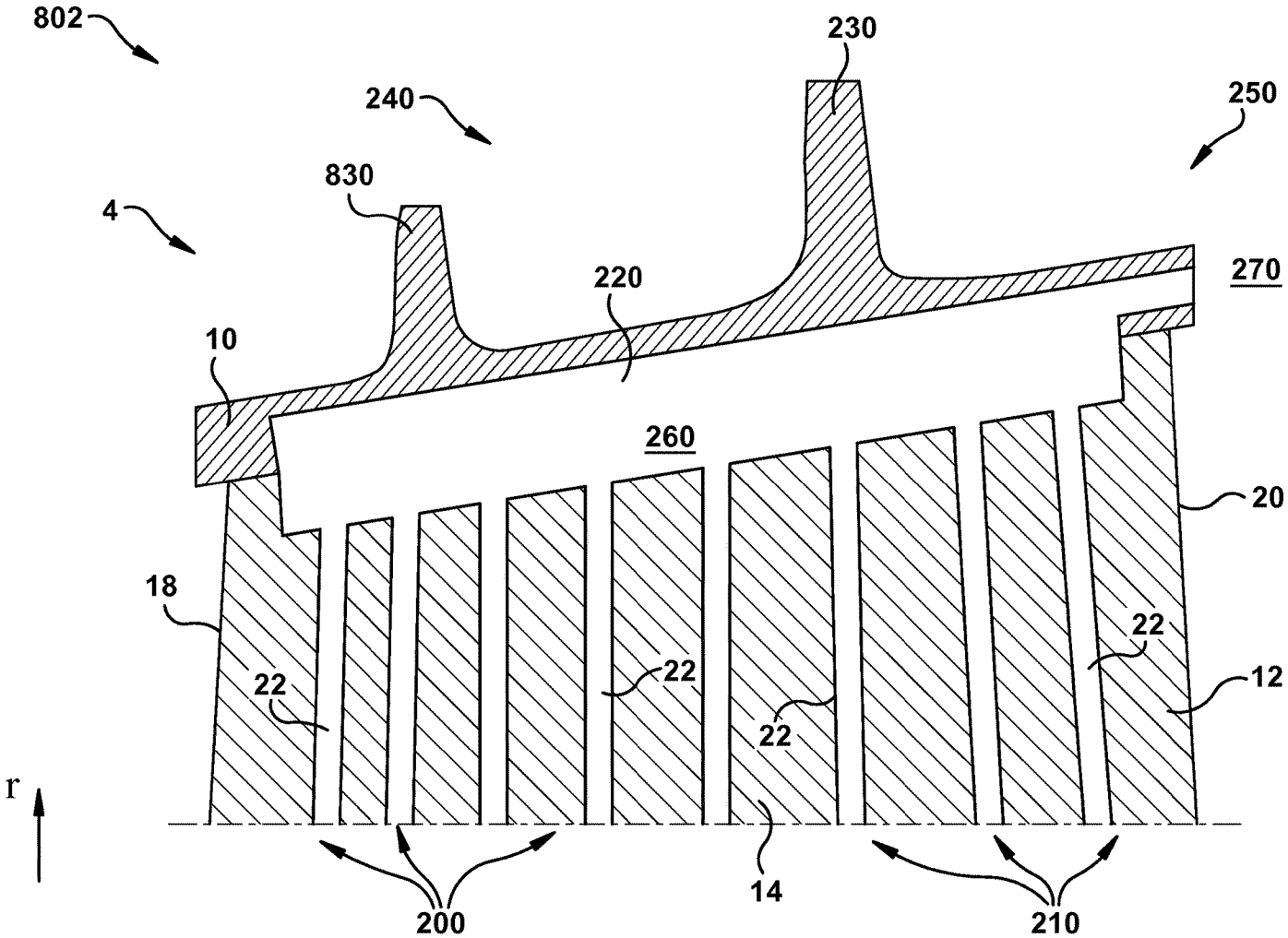
FIG. 8 shows a close-up schematic cross-sectional depiction of an additional bucket according to various embodiments.

FIG. 8 shows a close-up schematic cross-sectional depiction of an additional bucket 802 according to various embodiments. Bucket 802 can include a shroud 10 including a second rail 830, located within leading half 240 of shroud 10. Outlet path 220 can extend from second rail 630 to rail 230, and exit proximate trailing half 250 of shroud 10 to location 270, at trailing edge 20.

In contrast to conventional buckets, buckets 2, 302, 402, 802 having outlet path 220 allow for high-velocity cooling flow to be ejected from shroud 10 beyond rail 230 (circumferentially past rail 230, or, downstream of rail 230), aligning with the direction of hot gasses flowing proximate trailing edge 12. Similar to the hot gasses, the reaction force of cooling flow ejecting from shroud 10 (via outlet path 220) can generate a reaction force on bucket 2, 302, 402, 802. This reaction force can increase the overall torque on bucket 2, 302, 602, and increase the mechanical shaft power of a turbine employing bucket 2, 302, 402, 802. In the radially outboard region of shroud 10, static pressure is lower in trailing half region 250 than in leading half region 240. The cooling fluid pressure ratio is defined as a ratio of the delivery pressure of cooling fluid at base 6, to the ejection pressure at the hot gas path proximate radially outboard location 428 (referred to as "sink pressure"). Although there may be a specific cooling fluid pressure ratio requirement for buckets of each type of gas turbine, a reduction in the sink pressure can reduce the requirement for higher-pressure cooling fluid at the inlet proximate base 6. Bucket 2, 302, 402, 802, including outlet path 220 can reduce sink pressure when compared with conventional buckets, thus requiring a lower supply pressure from the compressor to maintain a same pressure ratio. This reduces the work required by the compressor (to compress cooling fluid), and improves efficiency in a gas turbine employing bucket 2, 302, 402, 802 relative to conventional buckets. Even further, buckets 2, 302, 402, 802 can aid in reducing mixing losses in a turbine employing such buckets. For example mixing losses in radially outer region 28 that are associated with mixing of cooling flow and tip leakage flow that exist in conventional configurations are greatly reduced by the directional flow of cooling fluid exiting outlet path 220. Further, cooling fluid exiting outlet path 220 is aligned with the direction of hot gas flow, reducing mixing losses between cold/hot fluid flow. Outlet path 220 can further aid in reducing mixing of cooling fluid with leading edge hot gas flows (when compared with conventional buckets), where rail 230 acts as a curtain-like mechanism. Outlet path 220 circulate the cooling fluid through the tip shroud 10, thereby reducing the metal temperature in shroud 10 when compared with conventional buckets. With the continuous drive to increase firing temperatures in gas turbines, buckets 2, 302, 402, 802 can enhance cooling in turbines employing such buckets, allowing for increased firing temperatures and greater turbine output.

Figure 9:
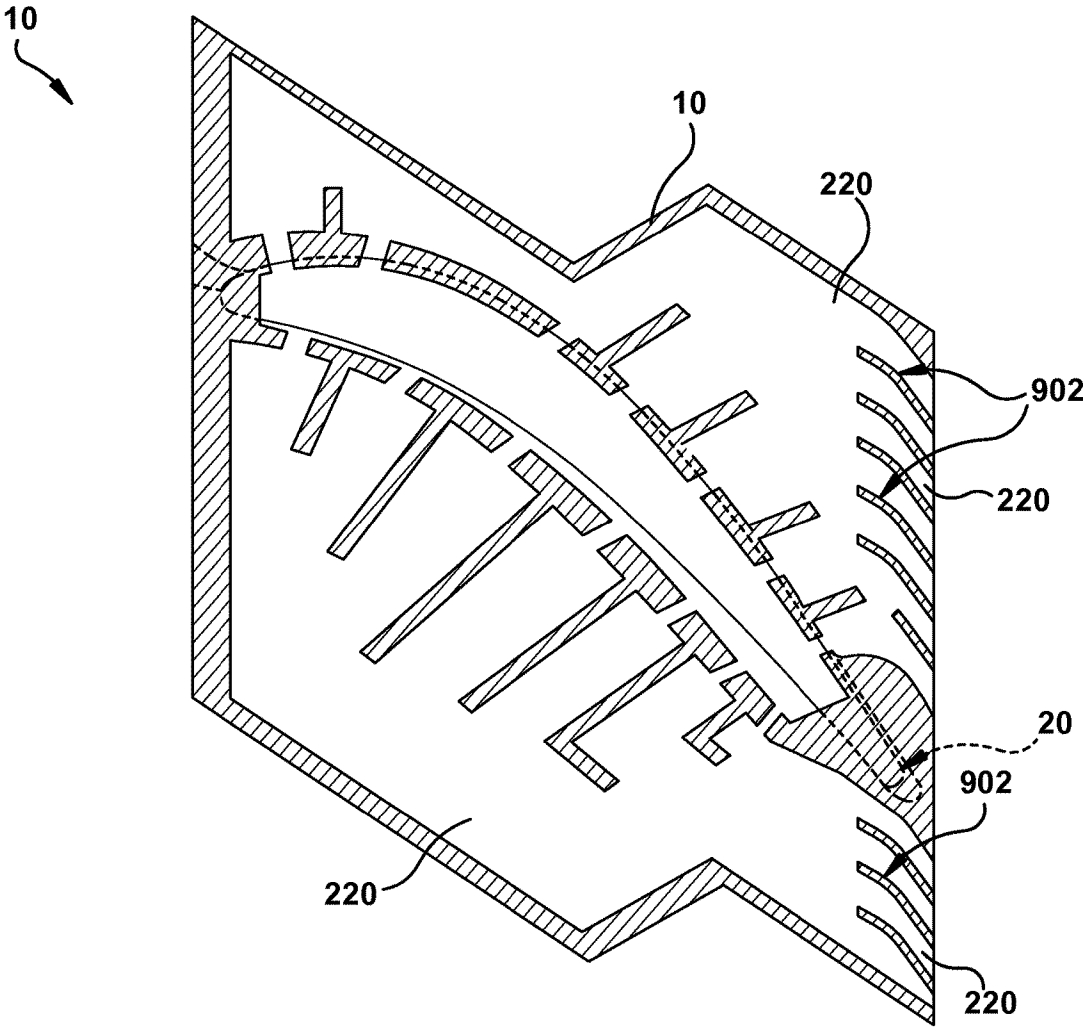
FIG. 9 shows a schematic top cut-away view of a portion of a bucket including at least one rib/guide vane proximate its trailing edge according to various embodiments.

FIG. 9 shows a schematic top cut-away view of a portion of bucket 2 including at least one rib/guide vane 902 proximate trailing edge 20 for guiding the flow of cooling fluid as it exits proximate shroud 10. The rib(s)/guide vanes(s) 902 can aid in aligning flow of the cooling fluid with the direction of the hot gas flow path.

Figure 10:
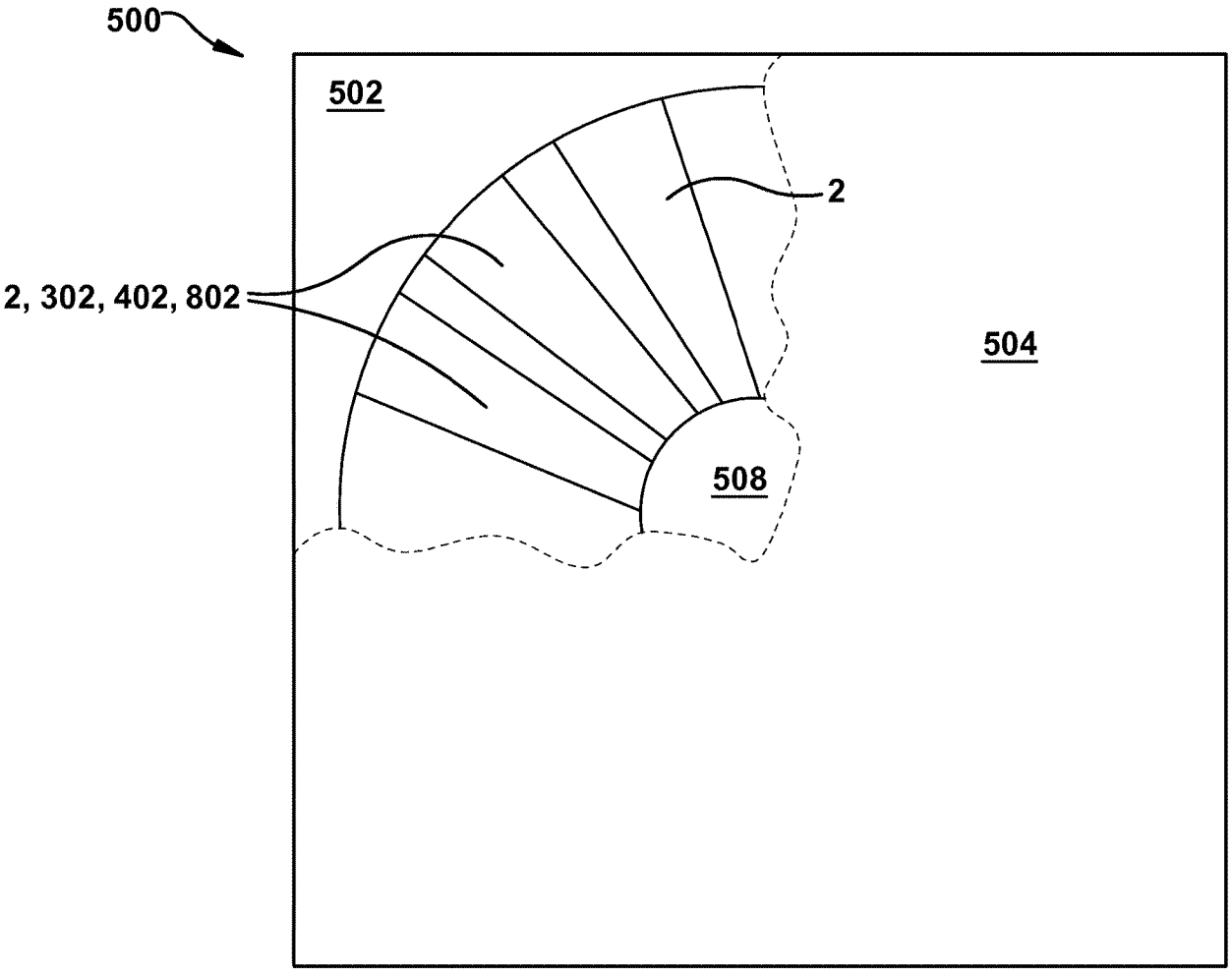
FIG. 10 shows a schematic partial cross-sectional depiction of a turbine according to various embodiments.

FIG. 10 shows a schematic partial cross-sectional depiction of a turbine 500, e.g., a gas turbine, according to various embodiments. Turbine 400 includes a stator 502 (shown within casing 504) and a rotor 506 within stator 502, as is known in the art. Rotor 506 can include a spindle 508, along with a plurality of buckets (e.g., buckets 2, 302, 402, 802) extending radially from spindle 508. It is understood that buckets (e.g., buckets 2, 302, 402, 802) within each stage of turbine 500 can be substantially a same type of bucket (e.g., bucket 2). In some cases, buckets (e.g., buckets 2, 302 and/or 402) can be located in a mid-stage within turbine 500. That is, where turbine 500 includes four (4) stages (axially dispersed along spindle 508, as is known in the art), buckets (e.g., buckets 2, 302, 402, 802) can be located in a second stage (stage 2), third stage (stage 3) or fourth stage (stage 4) within turbine 500, or, where turbine 500 includes five (5) stages (axially dispersed along spindle 508), buckets (e.g., buckets 2, 302, 402, 802) can be located in a third stage (stage 3) within turbine 500.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including:

an outlet path extending at least partially circumferentially through the shroud and fluidly connected with all of the plurality of radially extending cooling passageways within the body, wherein the outlet path exits the blade only at a trailing half of the shroud at the trailing edge of the body, wherein an entirety of a cooling fluid passing through the plurality of radially extending cooling passageways within the body exits the body through the outlet path.

2. The turbine bucket of claim 1, wherein the shroud includes a notch between the leading edge and the trailing edge of the body.

3. The turbine bucket of claim 1, wherein the outlet path includes at least one rib/guide vane proximate the trailing edge for guiding a flow of cooling fluid exiting the body.

4. The turbine bucket of claim 1, wherein the outlet path includes a chamber extending from the leading edge to the trailing edge.

5. A turbine bucket comprising:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge; and a shroud coupled to the blade radially outboard of the blade, the shroud including:

a notch between a leading half and a trailing half of the shroud;

a first plurality of radially extending cooling passageways within the body on the leading half of the shroud;

a first outlet path extending radially through the shroud on the leading half of the shroud, wherein an entirety of a cooling fluid passing through the first plurality of radially extending cooling passageways exits the first outlet path;

a second plurality of radially extending cooling passageways within the body on the trailing half of the shroud; and a second outlet path extending at least partially circumferentially through the trailing half of the shroud, and fluidly connected with the second plurality of radially extending cooling passageways within the body, wherein the second outlet path exits the blade only at the trailing half of the shroud, and wherein an entirety of a cooling fluid passing through the second plurality of radially extending cooling passageways exits the body through the second outlet path.

6. The turbine bucket of claim 5, wherein the second plurality of radially extending cooling passageways extend from the body to the second outlet path, and wherein the body further includes at least one rib/guide vane proximate the trailing edge for guiding a flow of cooling fluid exiting the body through the second outlet path.

* * * * *